US009657256B2

(12) United States Patent
Gelormino et al.

(10) Patent No.: US 9,657,256 B2
(45) Date of Patent: May 23, 2017

(54) ENVIRONMENTALLY SAFE PORCELAIN CLEANING FORMULATION, METHOD AND KIT

(71) Applicants: Scott Gelormino, Burlington, CT (US); Nicholas Romanelli, Burlington, CT (US)

(72) Inventors: Scott Gelormino, Burlington, CT (US); Nicholas Romanelli, Burlington, CT (US)

(73) Assignee: Mega Products, LLC, Burlington, CT (US)

( * ) Notice: Subject to any disclaimer, the term of this patent is extended or adjusted under 35 U.S.C. 154(b) by 0 days.

(21) Appl. No.: 14/853,995

(22) Filed: Sep. 14, 2015

(65) Prior Publication Data

US 2017/0073616 A1 Mar. 16, 2017

(51) Int. Cl.

| | |
|---|---|
| ***C11D 3/14*** | (2006.01) |
| ***C11D 3/20*** | (2006.01) |
| ***C11D 3/22*** | (2006.01) |
| ***A47L 13/16*** | (2006.01) |
| ***B08B 1/00*** | (2006.01) |

(52) U.S. Cl.

CPC ..... *C11D 3/14* (2013.01); *A47L 13/16* (2013.01); *B08B 1/002* (2013.01); *C11D 3/2065* (2013.01); *C11D 3/222* (2013.01)

(58) Field of Classification Search

CPC ..... C11D 3/14; C11D 3/2065; C11D 23/222; C11D 17/04; A47L 13/16; B08B 1/002

USPC ..... 451/111; 510/397, 505

See application file for complete search history.

(56) References Cited

U.S. PATENT DOCUMENTS

| | | | | | |
|---|---|---|---|---|---|
| 1,484,444 | A * | 2/1924 | Wilson | C11D 7/08 | 510/108 |
| 1,986,243 | A * | 1/1935 | Arveson | C11D 7/02 | 106/11 |
| 2,205,115 | A * | 6/1940 | Brown | C11D 7/02 | 424/641 |
| 2,442,024 | A * | 5/1948 | Smith et al. | C11D 3/18 | 510/242 |
| 2,716,850 | A * | 9/1955 | Reitzes | B24D 15/06 | 451/382 |
| 2,945,815 | A * | 7/1960 | Diaz | C11D 3/124 | 510/238 |
| 2,978,422 | A * | 4/1961 | Meister | C11D 3/14 | 106/10 |
| 3,997,460 | A * | 12/1976 | Sirine | C11D 3/14 | 134/3 |

(Continued)

*Primary Examiner* — George Nguyen

(74) *Attorney, Agent, or Firm* — Handal & Morofsky, LLC

(57) ABSTRACT

A cleaning composition for porcelain comprises abrasive material and a carrier, wherein the carrier is water-based. The abrasive material comprises pumice with a particle size distribution such that at least 35 percent of the particles fall are 250 to 750 microns and wherein the carrier comprises a biodegradable gum in an amount sufficient to act as a thickener and suspending agent for the pumice. The cleaning composition further comprises glycerin and further comprises between 30% and 60% by weight pumice. The cleaning composition further comprises between 0.8% and 2.5% biodegradable gum and a thickener selected from one or more members of the group consisting of guar gum, locust bean gum, tara gum, xanthan, carrageenan, gellan gum and vegetable gum.

19 Claims, 5 Drawing Sheets

(56) References Cited

U.S. PATENT DOCUMENTS 4,051,055 A * 9/1977 Trinh ..... C11D 3/046 510/238
4,302,253 A * 11/1981 Ciullo ..... C08L 5/00 106/205.01
4,512,677 A * 4/1985 Trinh ..... A47L 13/17 401/200
4,597,887 A * 7/1986 Colodney ..... C11D 1/62 134/2
4,784,788 A * 11/1988 Lancz ..... C11D 17/003 510/108
4,931,201 A * 6/1990 Julemont ..... A47L 13/17 15/104.93
5,393,454 A * 2/1995 Mondin ..... C11D 3/18 510/242
5,429,545 A * 7/1995 Meyer ..... A47L 13/17 451/523
5,731,276 A * 3/1998 Argo ..... C11D 3/046 510/284
6,142,868 A * 11/2000 Pfanstiehl ..... B05C 17/00 15/169
2002/0102919 A1* 8/2002 Lalli ..... G11B 23/505 451/41
2002/0144712 A1* 10/2002 Barger ..... B01J 39/043 134/6
2005/0136238 A1* 6/2005 Lindsay ..... A47L 13/16 428/304.4
2005/0239381 A1* 10/2005 Mesa ..... B24B 29/00 451/54
2006/0096614 A1* 5/2006 Krisko ..... A47L 1/15 134/6
2007/0238633 A1* 10/2007 Johnson ..... C11D 3/226 510/389
2008/0255023 A1* 10/2008 Shimmin ..... C11D 1/662 510/470
2009/0264059 A1* 10/2009 Zagone ..... B24D 11/00 451/539
2010/0254915 A1* 10/2010 Kao ..... A61K 8/19 424/49
2012/0288623 A1* 11/2012 Boler ..... B24B 29/02 427/140
2012/0309273 A1* 12/2012 Popov ..... B24D 15/023 451/57
2014/0045412 A1* 2/2014 Yuska ..... C11D 7/261 451/59

* cited by examiner

ENVIRONMENTALLY SAFE PORCELAIN CLEANING FORMULATION, METHOD AND KIT

TECHNICAL FIELD

The invention relates to abrasive particle cleaning products and methods, and, more particularly, to a novel cleaning formulation which environmentally manages interparticle and applicator-to-particle interactions to mechanically position particles for effective cleaning.

CROSS REFERENCE TO RELATED APPLICATIONS (Not applicable)

BACKGROUND OF THE INVENTION

For most consumers, cleaning porcelain, for example in a bathroom or other area, is a disagreeable, difficult and, often, ineffectively executed task. More problematic, in geographic areas where water hardness exceeds ideal levels (85% of the United States), cleaning bathroom surfaces, such as sinks, toilets, and tubs is especially challenging due to more serious build-ups of scum, hard water rings, rust, or lime and other mineral deposits. Moreover, cleaning requires that a consumer must usually buy additional items, such as sponges, scrub pads, brushes or applicators before a porcelain cleaner can be used. This creates the possibility that inappropriate implements will be used because they are on hand without purchase, or that the consumer will purchase the wrong applicators. In both cases, the consumer may not even recognize there is a problem.

SUMMARY OF THE INVENTION

Perhaps more seriously, cleaning products, in addition to including abrasive constituents, may rely on harsh chemicals designed to attack the constituent elements of built-up stains using a variety of chemical modalities, such as oxidation (for example chlorine-based products, or potentially more aggressive solutions such as muriatic acid, and so forth), surfactant activity and so forth. These attack the hands of the user, for example by burning off one or multiple layers of skin, and adversely affect the environment by leaving poisonous and very long-lived materials in the environment, whether that environment is a river, and ocean or more seriously, a septic field. These concerns may be particularly serious given the widespread use of septic systems and the relatively common occurrence of people having home gardens where, somewhat ironically, they might raise greens, vegetables, fruit and other crops with the objective of having a relatively clean source of food.

Further environmental concerns are raised by the relatively high mobility of chemical agents when they enter the environment. Moreover, many stains may be resistant to chemical-based cleaning compounds. While some products include abrasives, those products that include very fine abrasive particles (typically in a range about approximately 50 microns) in the formulation are most effective, despite the omission of larger potentially more abrasive larger particles. Such very fine abrasive particle formulation products are applied using a sponge, cloth or the like. The combination of sponge and fine particles results in direct mechanical pressing to fix the position of enough abrasive particles to clean a surface with a modest degree of effectiveness, provided that a relatively large patch of sponge is subjected to pressure by the fingers of the user.

The present invention recognizes that larger abrasive particles are most effective when distributed evenly, but tend to accumulate in areas where they are not needed when mechanically scrubbed. They thus tend to scatter away from the point of application of force, using, for example, a sponge. Accordingly, such cleaners are applied in dry powder form evenly over the area to be cleaned, and then scrubbed with a cloth, following which the particles will quickly absorb into the cloth during scrubbing. New particles must then be applied.

Similarly, when using a brush, during scrubbing, larger particles easily slip between bristles to positions where their abrasive effect is substantially compromised.

In contrast, in accordance with the present invention, the viscosity of a cleaning preparation is controllably increased. During cleaning, the top surface of a deposit of cleaning preparation is put in contact with the bottom surface of a sponge, scouring pad or other applicator (such as a cloth) which under the influence of pressure applied by the hands of the individual performing the cleaning, is subjected to movement substantially parallel to the surface being cleaned.

In accordance with the invention, viscosity is controlled in the non-Newtonian fluid in which abrasive particles are suspended to achieve desired abrasive orientation. Relative to the movement of the applicator, the workpiece being cleaned (such as the porcelain surface of a toilet bowl) is stationary, resulting in shear forces which equate to the application of one torque at the work surface associated with the workpiece, and the opposite torque at the work surface associated with the applicator.

This results in rotating particles which are suspended within the relatively high viscosity cleaning preparation. The result is that, particularly in the case of the relatively large particles of abrasive material, suspended abrasives in the inventive cleaning preparation rotate to positions where they tend to lock against further rotation or slippage, thus resulting in more effective use of the forces applied to the cleaning preparation, and, in particular, the abrasive particles entrained therein. Because the invention uses relatively large abrasive particles, they tend to be rotated to a position where relatively pointed abrasive configurations are statically driven against the porcelain surface being cleaned. Thus, movement of the applicator parallel to the workpiece results in dragging these relatively pointed configurations against the workpiece with a minimal area of contact between the workpiece and the abrasives, but with a relatively large amount of force concentrated in and directed against the point of contact of the abrasive with the workpiece. Accordingly, relatively high pressure is concentrated at the point of interface between the abrasive material and the workpiece, thus resulting in substantial scraping forces being applied to accumulations of dirt, stains, mineral accumulations, and so forth deposited on the top surface of the porcelain being cleaned.

In recent years, bathroom cleaning product kits have also been introduced to the market, typically comprising reusable or disposable pads (sometimes incorporating cleaning material) and handles on which they are mounted. However, these kits have shortcomings since they are geared towards cleaning only certain sections of the bathroom. Some bathroom cleaner kits are geared toward cleaning toilet bowls only, whereas others are geared toward cleaning bath tubs only.

While this allows a consumer to purchase a cleaning kit for a specific task, another problem emerges. In order to clean the whole bathroom, which among other things, includes cleaning the bath tub, toilet, and sink, the consumer will have to buy multiple products to get the job done. When the consumer purchases one of these specific cleaner kits, the consumer will also have to acquire additional items, such as sponges, brushes, or scrub pads because accessories that comprise these specialized bathroom cleaner kits may not be designed to be used to clean other bathroom surfaces.

In addition, even the cleaning kits specifically designed to target particular areas of the bathroom have shortcomings in performing the tasks to which they are specifically designed for and dedicated. For example, when purchasing a toilet bowl cleaning kit, a consumer gets the cleaner with just a brush. Moreover, the brush, while it is effective to clean visible portions of the toilet bowl, has a shape which precludes the consumer from most effectively targeting and efficiently cleaning the underside of the toilet bowl periphery where the water ports, which feed the flushing operation, are located. As a result of this, water flow is restricted, the toilet bowl requires multiple flushes and, often, perfectly serviceable toilet bowls are discarded.

Other cleaning kits comprise a cleaner and a sponge. While a sponge will work for large surface areas, one embodiment of the invention provides a cleaner with a separate brush and a sponge, abrasive particles having a range of larger sizes, and, most importantly, a composition with a thickening agent designed to increase the effectiveness of the larger abrasive particles by fixing position and providing for particle rotation to optimal or at least relatively effective positions with the particular applicators used, giving the inventive kit substantial capability over prior art.

In addition, in accordance with the present invention, a brush and/or an applicator with a handle is provided. A preferred embodiment of the invention uses a scouring pad including a sponge and a fibrous top surface. Relatively stiff closely packed bristles or, alternatively, the sponge-based scouring pad are used in the brush of the inventive system because, in combination with the viscous, non-Newtonian nature of the carrier, they effectively trap large particulate particles, such as particles of pumice, and hold them in positions where they tend to be rotationally stabilized and bear against the porcelain surface being cleaned. More particularly, the viscosity of a mixture of the inventive cleaning composition not only maintains the particles in a suspended position which promotes even distribution of abrasive material, but also, working with the viscosity of the suspension maintains the particles proximate to the tips of the bristles, where they can be driven by flexed bristles against the surface being cleaned. In this configuration, the bent brush bristle tip is slanted at, for example, a 60° angle to the surface being cleaned, and the pumice (or other abrasive material) particles are pushed by the flexed bristles against the surface being cleaned and driven toward the forces adjacent the surface being cleaned and the tip of the bristle, where further movement either in the lateral direction (with respect to the brush) or of a rotational nature is prevented as the relatively large abrasive particle is wedged into the applicator surfaces and driven across the surface being cleaned.

The present invention, in this manner, provides a solution to the above discussed problems. At the same time, thickening is provided by a natural agent which is both user-friendly and environment friendly. As compared to prior art harsh chemicals which can damage the skin of the user, whether chlorine bleach, muriatic acid or other infective agents, the inventive composition has the effect of increasing the strength of the cleaner, while without adversely affecting the environment in any substantial way.

The cleaning compound and kit of the present invention provides the consumer a porcelain cleaner kit that may be used to remove hard water rings, rust, lime and mineral deposits on multiple porcelain surfaces, such as toilet bowl inner surfaces, toilet bowl water feeding jets, tubs, and sinks. Thus, the consumer has the flexibility to conform the cleaner kit to the requirements of the job and use it on multiple bathroom surfaces.

For this reason, among others, the inventive ready-to-use porcelain cleaner composition and kit will save the consumer time, and often money, because the consumer will not have a need to purchase additional items to clean a bathroom. Moreover, the inventive system ensures that the combination of applicators and cleaning composition are all properly formulated to work with each other and with a wide variety of porcelain surfaces.

The inventive ready-to-use porcelain cleaner kit has packaged together all components necessary for a wide range of porcelain cleaning jobs and is thus ready for use from the time of purchase. In addition, purchasing a ready-to-use porcelain cleaner kit reduces unnecessary pollution that is generated when the consumer buys these specific bathroom cleaning kits and then must buy additional accessories to clean other bathroom surfaces, and discard unsuitable cleaning compositions, brushes or other applicators.

Furthermore, inventive ready-to-use porcelain cleaning kit has a brush whose shape is designed to specifically target hard to reach areas, such as the underside of a toilet bowl where the water feeding ports are located.

When packaged together, the kit reduces manufacturing costs, assures efficient retail stock placement, and enables the consumer to use the product immediately after purchase because all relevant components are included and matched to the performance characteristics of the cleaning composition.

In accordance with the invention, the pumice particle size distribution used desirably meets the specification of: for 1400 Micron or 14 U.S. Mesh allows 100% passing, 600 Micron or 30 U.S. Mesh allows 99.7-100 passing, 425 Micron or 40 U.S. Mesh allows 47%-67% passing, 300 Micron or 50 U.S. Mesh allows 3% -17% passing, 250 Micron or 60 U.S. Mesh allows 0% to 12% passing.

BRIEF DESCRIPTION OF THE DRAWINGS

The operation of the invention will become apparent from the following description taken in conjunction with the drawings, in which.

DETAILED DESCRIPTION OF THE PREFERRED EMBODIMENTS

Figure 1:
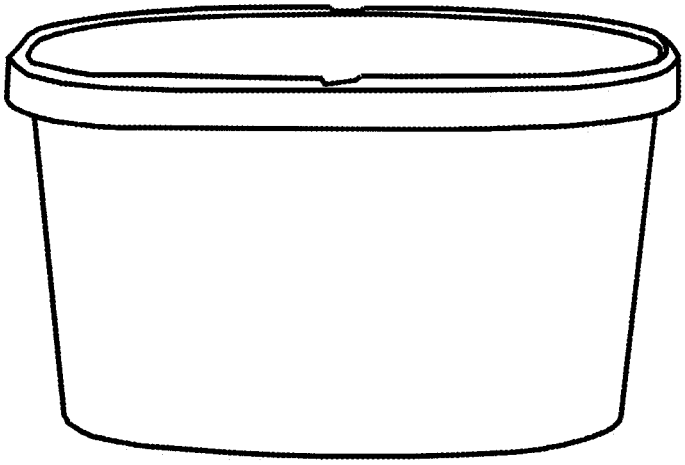
FIG. 1 is a perspective view of the storage container that houses the cleaning kit components.

Cleaning efficiency of a brush is believed to depend on the access of toothbrush bristles to sheltered areas and their ability to deliver sufficient force to remove accumulations as tufts of bristles travel over surfaces being cleaned. As a first-order approximation, brush stiffness may be said to predominantly depend upon elastic modulus of the bristles, bristle and tuft diameter, the number of tufts of bristles in the brush, the number of bristles per unit area packed into a particular tuft supporting hole, sometimes referred to as the packing factor, and the trim length of bristles. While the above characteristics are believed to be the primary influencers of brush hardness and cleaning efficiency, bristle composition and shape are believed, by some, to have no measurable effect. See, for example, Rawls et al, *A Mathematical Model for Predicting Toothbrush Stiffness*, available at http://www.ncbi.nlm.nih.gov/pubmed/2079171.

In accordance with the invention, the cooperative relationship between larger particles and a relatively viscous cleaning composition carrier is used to advantage, with the viscosity of the cleaning composition carrier acting to promote interparticle and particle to applicator interactions which result in stabilizing agglomerations of particles and structural abrasive particle interlocking with the applicator to ensure localized and stable accumulations of abrasive materials in configurations designed to apply significant forces to accumulations of foreign matter on porcelain surfaces.

More particularly, in one alcohol-based embodiment of the inventive cleaning composition, the liquid ingredients comprise linear alcohol ethoxylate (a coconut surfactant for cleaning/rinsing/stability), alkyl polyglucoside (sugar cane/coconut surfactant for cleaning/rinsing/stability), xanthan gum (a food grade environmentally friendly thickening agent), essential oils (e.g. lemon, mint, lavender, orange) and calcium carbonate (whitens the color of the mixture).

To make the final formulation, the above liquid ingredients are mixed with pumice, 50% by weight liquid ingredients, and 50% by weight pumice. However, the percentage of pumice can range between 25% and 90% by weight of the final cleaning formulation. However, pumice concentrations between 40% and 65% by weight are preferred, and concentrations between 45% and 60% by weight are particularly preferred.

In an alternative and particularly preferred but water-based embodiment of the invention, the ingredients comprise water—52%, xanthan gum—1.3% (natural thickener & suspending agent for the pumice), glycerin—5% (prevents water from evaporating, derived from coconut oil), laureth—9-1.00% (natural surfactant from coconut oil), peppermint oil—0.20% (natural Indonesian peppermint oil), sodium benzoate—0.50% (fda approved food grade preservative, keeps formula from going rancid), and pumice—40%.

The percentage of pumice can range between 10% and 60% by weight of the final cleaning formulation. However, pumice concentrations between 30% and 60% by weight are preferred, and concentrations between 35% and 50% by weight are particularly preferred. Relative concentrations of the other (liquid) ingredients may, for example, be increased or decreased proportionately.

Suitable thickeners include such gums as guar gum, locust bean gum (also known as carob bean gum), tara gum, xanthan, carrageenan, gellan gum or other vegetable or non-vegetable based thickeners, and may be included in concentrations between 0.3% and 9% by weight of the final composition, although concentrations between 0.5% and 4% by weight are preferred, and concentrations between 0.8% and 2.5% are particularly preferred. Combinations of natural gums, for example guar and xanthan with equal amounts of guar and xanthan have been found to have a synergistic effect.

In accordance with the invention, the preferred abrasive is available from HESS Pumice Products, Inc. of Malad, Id. It comprises an igneous composition, namely pumice. This grade hardness of pumice is sold by Hess as Pumice Grade #2, and comprises a mineral known as pumicite. This is a non-crystalline silica, a mineral which is a member of the rhyolite family. The product used in the invention includes 0.3% impurities none of which are hazardous. The pumice is very white with a GE brightness of 84. Likewise, the product is very hard with a hardness on MOH'S scale of 5.8. Its specific gravity is 2.35 g/cc. Depending on grade the pumice may have a weight of 40-50 pounds per cubic foot. Pumice also has the advantage of being chemically and environmentally inert.

In the inventive formulation, the highly porous nature of the pumice enables it to hold water and air. It is also very close to pH neutral, having a pH at 20° C. range of 7.5-8, and thus from chemical standpoint, not likely to cause any irritation to human skin.

The cleaning composition used in the inventive kit has numerous other advantages. Moreover, tests have shown that is highly effective against a wide range of undesirable porcelain accumulations, while, at the same time, not scratching or otherwise adversely affecting the porcelain being cleaned. It is thus an effective answer to the problem of hard water fixture cleaning, a problem which affects 85% of the country based on information reported by the U.S. Geological Survey. Further, the inventive kit is effective in cleaning porcelain, regardless of age, because, despite significant changes in the manufacturing process, porcelain characteristics upon which the invention depends have not changed. As alluded to above, the product is not harmful to human skin, or even sensitive human skin. Nevertheless, it is very effective in breaking down and cleaning the calcium, magnesium and other mineral buildups, and other accumulations which porcelain suffers from. Thus, effective removal of rust stains, mineral deposits, limescale and oxidation products is achieved.

Moreover, the inventive kit includes scour pads and a contoured applicator handle for ease of cleaning, as appears more fully below. In addition, a special brush is included for the purpose of cleaning rim ports and the secondary feed hole near the drain to allow more efficient water flow to the toilet. At the same time, the inventive system includes no harmful chemicals, which are safe for adults, children and pets due to their chemically benign nature.

Also, as alluded to above, inventive kit is effective against chemically resistant stains that much harsher cleaners including oxidizers such as bleach and acids effectively combat. At the same time, the viscosity of the cleaning preparation of the invention provides for more effective and evenly spread deployment of the pumice abrasive both during application and during use, as well as the time that the inventive composition is sitting on the surface without being worked as the user moves from one area to another in the cleaning operation, while providing for the convenience of deposit on vertical surfaces and, accordingly, easier cleaning.

After use, the container provided with the kit provides for organized storing of the complete system in one place for easy retrieval and a low likelihood of loss of one or more components.

Moreover, in accordance with a preferred embodiment of the invention, packaging materials are selected for suitability for recycling and reuse, thus further increasing the environmentally friendly nature of the product.

In accordance with one embodiment of the invention, scouring pads may optionally be made from biodegradable plastic, with or without incorporated cleaning formulation. In addition, the cleaning brush included in the inventive kit may optionally be made of a wooden handle with natural bristles. Packaging may be made from raw cardboard, without plastic coating, glaze, varnish or other embellishments. For example, the container may be made of raw cardboard printed with a biodegradable ink, such as carbon black suspended in a vegetable oil carrier.

Thus, the entire kit of the present invention may be made biodegradable and of completely sustainable materials.

Referring to FIG. 1, the inventive kit comprises a storage container 10, which is made of a tub 12 and a lid 14 of conventional design. In accordance with a preferred embodiment, both tub 12 and lid 14 are optionally made of raw cardboard. To improve the longevity of storage container 10 (which also serves as the product package), lid 14 may include a plastic rim 16, with a structure substantially similar to that of a conventional ice cream container tub of the type used in retail supermarket sales.

Figure 2:
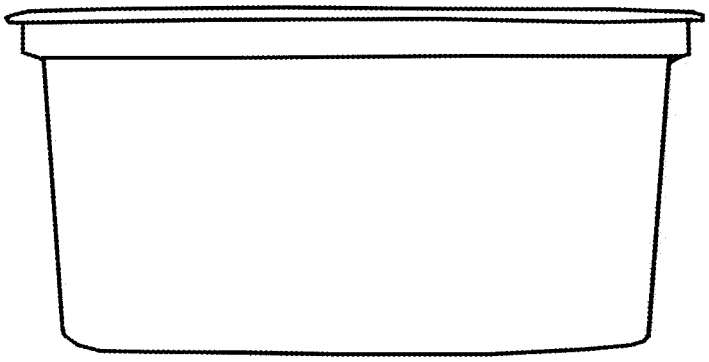
FIG. 2 is a perspective view of the porcelain cleaner container.

At sale, all components of the kit are contained within storage container 10. These include a small tub 18 of porcelain cleaning composition of the type described above. See FIG. 2. Optionally, tub 18 may be made of plastic or in a more environmentally attractive alternative. In accordance with the present invention tub 18 may be made of cardboard coated with a resinous material such as PVC plastic or a conventional waterproofing coating. A cover 19 is used to close tub 18.

Figure 3:
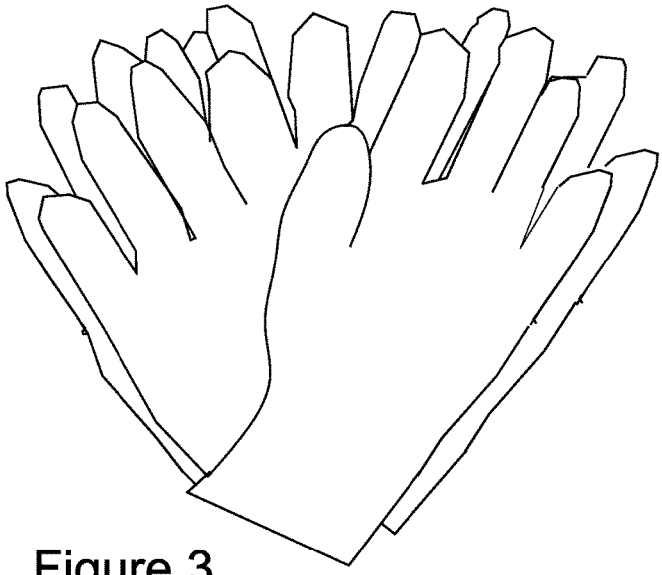
FIG. 3 is a perspective view of a five-fingered hand protective material.

The inventive kit further comprises two pairs of gloves 20, as illustrated in FIG. 3. The gloves may be of conventional design, for example flexible latex rubber of the type typically included in boxes of disposable plastic gloves. Such gloves may be of relatively light design, in so far as the inventive cleaning application is substantially chemically inert. However, the gloves also provide the advantage, largely psychological, of removing the unpleasantness associated with cleaning, especially the cleaning of the porcelain surface of a toilet bowl. While the gloves likely will prevent any germs, bacteria or the like from contacting the hands of the person doing the cleaning, nevertheless, it is recommended, in accordance with the invention that hands be washed after the completion of the cleaning task.

Figure 4:
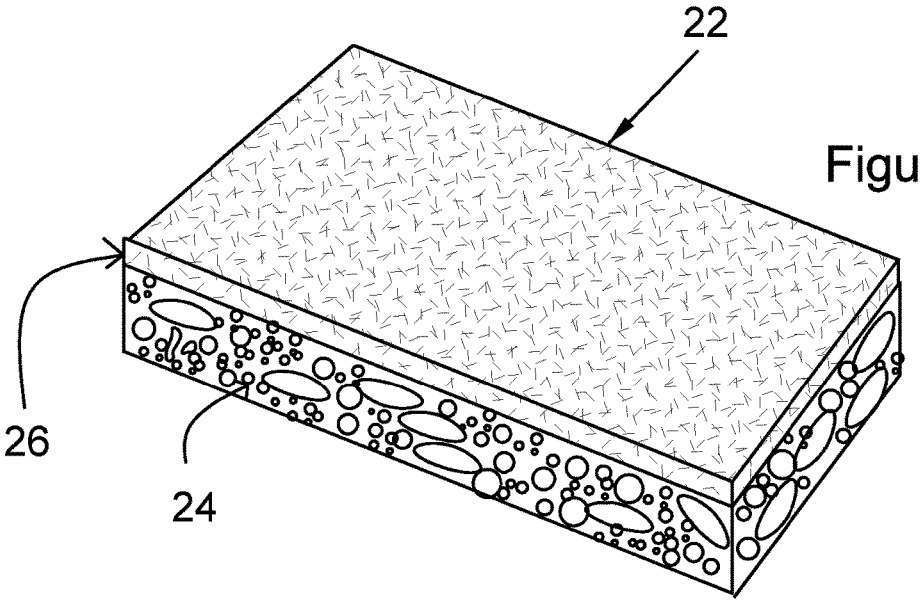
FIG. 4 is a perspective view of a deformable material incorporating voids.

Referring to FIG. 4, the inventive kit further comprises a pair of sponges. Each of the sponges 22 optionally comprises a sponge layer 24 and scouring layer 26. Sponges 22 may be of any one of a number of sizes, for example 4"×2.5" by 19/16 inches thick. Sponge layer 24 may be 7/16 of an inch thick. Scouring layer 26 may be 3/16 of an inch thick. Scouring layer 26 may be made of fibers of the type conventionally found in scouring sponges.

Figure 5:
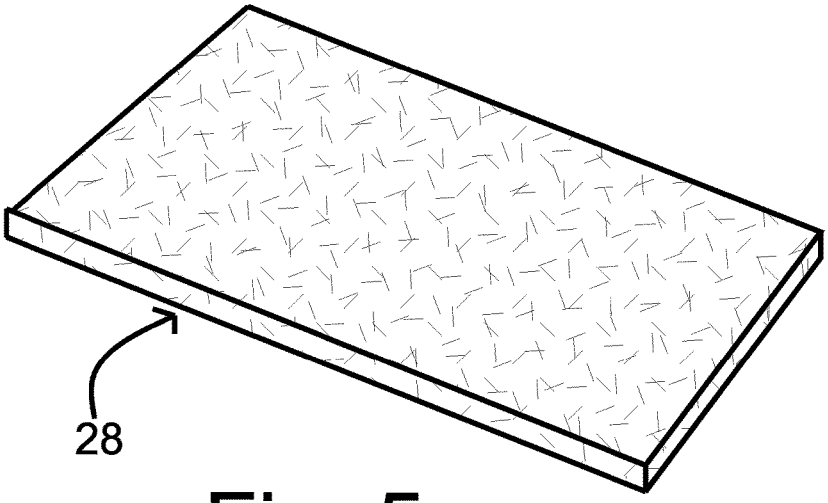
FIG. 5 is a perspective view of a scrubbing material incorporating voids.

The kit further comprises a pair of scouring pads 28, as illustrated in FIG. 5. Each scouring pad 28 may be of any one of a number of sizes, for example 4"×2.5" by 3/16 inches thick. Scouring pad 28 may be of conventional design, comprising fibrous material bonded together. Both scouring pad 28 and scouring layer 26 of sponge 22 may include an abrasive material. Such abrasive material may be pumice of the type described above. However, other abrasives less prone to breaking down and crumbling may optionally be employed. Such other abrasives, but bonded to the fibers, may be designed to maintain their structural integrity under forces of the type and magnitude normally employed by the hand in performing a scrubbing operation. Scouring pad 28 may, optionally, have a more abrasive characteristic than scouring layer 26 of sponge 22.

Figure 6:
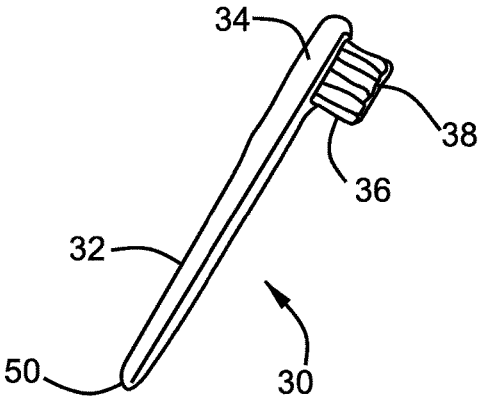
FIG. 6 is a perspective view of an applicator.

The inventive kit also comprises a scrubbing brush 30 as illustrated in FIG. 6. Brush 30 has an elongated handle 32 and a brush portion 34. Brush portion 34 comprises six tufts 36 of bristles 38, each, in close proximity to each other. In accordance with a preferred embodiment of the invention, two rows of six tufts each, for a total of 12 tufts may be employed.

A number of typical brushes were evaluated. This evaluation was performed by orienting the bristles at a 45° angle with respect to the weighing surface of a scale, while the body of the brush (within which the bristles were held) was subjected to a force at a 90° angle to the surface of the scale. The force exerted by the bristles in two tufts was measured, allowing stiffness to be determined by noting the displacement distance of the bristle supporting structure of the brush. Results are shown in the chart below:

| Brush ID and Description | Force | Tip Displacement | Length | #Bristles |
|---|---|---|---|---|
| A. Pink Toothbrush | 1.8 oz. | 2/16 in. | 5/16 in. | 26 |
| A. Pink Toothbrush | .6 oz. | 1/16 in. | 5/16 in. | 26 |
| B. Black Toothbrush | .7 oz. | 1/16 in. | .5 inches | 32 |
| C. 1.3 in × 2.3 in. Scrubber | 3 oz. | 2/16 in. | 11/16 in. | 10 |
| C. 1.3 in × 2.3 in. Scrubber | 1.5 oz. | 1/16 in. | 11/16 in. | 10 |
| D. 1 in. × .5 in. Kitchen Brush | 2.8 oz. | 2/16 in. | .5 in. | 22 |
| E. 1 in. × .5 in. Kitchen Brush | 1.5 oz. | 1/16 in. | .5 in. | 22 |

Brushes C, D and E were found most suitable after tactile inspection of the brushes. Brushes A and B were found less suitable after tactile inspection of the brushes.

Figure 7:
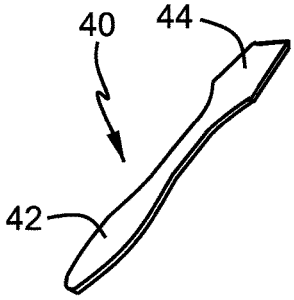
FIG. 7 is a perspective view of a specialty brush.

The inventive kit also comprises a spatula 40, as illustrated in FIG. 7, which may be made of plastic and includes a rigid handle portion 42 and an applicator portion 44 which may be flexible. Applicator portion 44 has a width of approximately 0.5 inches, although widths between 0.25 inches and 1 inch or even wider will work well.

In accordance with the invention, when it is desired to use the inventive system, the individual doing the cleaning puts on gloves 20. A quantity of cleaning compound 46 contained within tub 18 is scooped up with spatula 40, and applied to the porcelain surface to be cleaned, or, optionally, to brush 30, scouring pad 28 or sponge 22.

In accordance with the invention, it is contemplated that general cleaning will first be done with a sponge 22. Areas requiring more attention are then scoured with scouring pad 28. After that, the most problematic areas may be scoured with brush 30.

Figure 8:
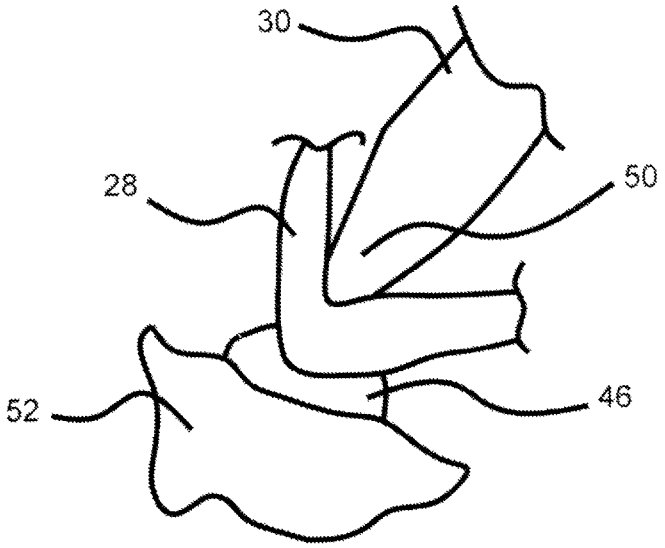
FIG. 8 illustrates cleaning using the inventive formulation.
Figure 9:
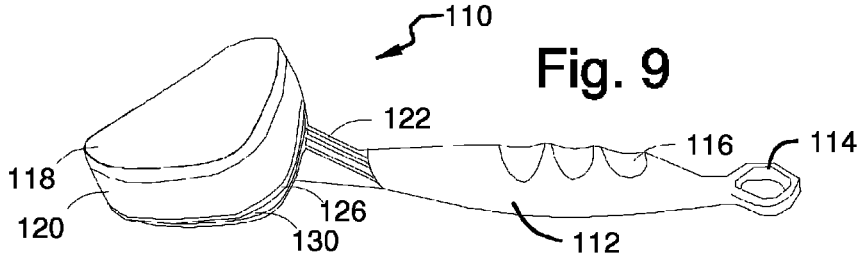
FIG. 9 is a perspective view of a specialty applicator.
Figure 11:
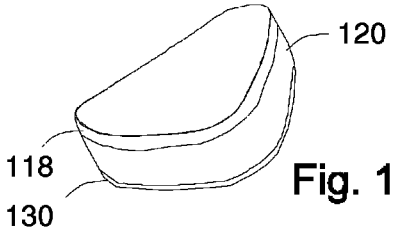
FIG. 11 is a perspective view from the top of the sponge of the specialty applicator of FIG. 9, exposing a fibrous cleaning member.
Figure 12:
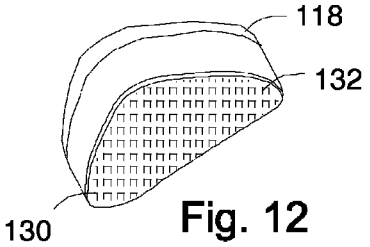
FIG. 12 is a perspective view from the bottom of the sponge of the specialty applicator of FIG. 9, exposing the attachment member.
Figure 10:
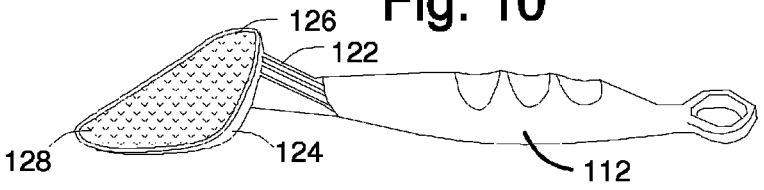
FIG. 10 is a perspective view of a handle portion of the specialty applicator of FIG. 9.

Finally, the very effective cleaning may be obtained by applying a quantity of cleaning formulation 46 to a scouring pad 28 and then pressing the rounded end 50 of scrubbing brush 30 into the path and against the porcelain area 52 to be cleaned, as illustrated in FIG. 8.

Turning to FIGS. 9-12, a particularly advantageous embodiment of a scrub brush for applying the cleaning composition of the present invention is illustrated. Generally, brush 110 comprises a handle 112 which has a loop 114 for allowing brush 110 to be hung when not in use. Handle 112 includes a number of finger gripping notches 116. Cleaning is implemented using a fibrous layer 118 which is supported on a sponge 120. Fibrous layer 118 receives the cleaning composition of the present invention and is used to apply it to the workpiece and to scrub the workpiece. Fibrous layer 118 may optionally incorporate abrasive particles.

Handle 112 may be formed of plastic from a single injection molded member together with extension arm 122 and support panel 124. A Velcro attachment member 126 comprising, for example, a fabric with hooks 128 is attached by glue to support panel 124.

Sponge 120 has fibrous layer 118 adhered to it. A mating Velcro® fabric 130 having loops 132 is adhered to the bottom surface of sponge 120.

While an illustrative embodiment of the invention has been described, it is, of course, understood that various modifications of the structures, compositions and methods described herein will be apparent to those of ordinary skill in the art in view of the above disclosure accompanying drawings. Such modifications are within the spirit and scope of the invention, which is limited and defined only by the appended claims.

What is claimed is:

1. A porcelain cleaning kit, comprising:

(a) a storage container;

(b) a cleaning composition comprising abrasive material and a carrier, said cleaning composition being contained within a cleaning composition container, said cleaning composition container being disposed in said storage container;

(c) a hand protective member contained within said storage container;

(d) a deformable member incorporating voids contained within said storage container;

(e) a scrubbing member incorporating voids contained within said storage container;

(f) an applicator contained within said storage container; and (g) a composition applicator contained within said storage container.

2. A porcelain cleaner kit as in claim 1, wherein the cleaning composition is water-based and comprises pumice and a biodegradable gum in an amount sufficient to act as a thickener and suspending agent for the pumice.

3. A porcelain cleaner kit as in claim 2, wherein the cleaning composition further comprises glycerin.

4. A porcelain cleaner kit as in claim 1, where the hand protective member comprises a glove comprising a polymer selected from the group consisting of latex, nitrile rubber, neoprene, and vinyl, or a flexible resinous material.

5. A porcelain cleaner kit as in claim 1, where the deformable material is made of cellulose wood fibers or foamed plastic polymers or any other material suitable to clean surfaces.

6. A porcelain cleaner kit as in claim 1, wherein said abrasive material comprises pumice with a particle size distribution such that at least 35 percent of the particles fall are 250 to 750 microns , and said cleaning composition comprises between 30% and 60% by weight pumice, and said cleaning composition comprises between 0.8% and 2.5% biodegradable gum.

7. A porcelain cleaner kit as in claim 6, where the deformable material has pumice incorporated into voids.

8. A porcelain cleaner kit as in claim 1, where the deformable member is non-fibrous.

9. A porcelain cleaner kit as in claim 1, wherein the cleaning composition comprises between 30% and 60% by weight pumice and a thickener selected from one or more members of the group consisting of guar gum, locust bean gum, tara gum, xanthan, carrageenan, gellan gum and vegetable gum.

10. A porcelain cleaner kit as in claim 9, the abrasive material is pumice with particle size distribution such that 35 to 85 percent of the particles fall within in the range of 325 to 1400 microns.

11. A porcelain cleaner kit as in claim 10, wherein the cleaning composition further comprises glycerin in a concentration of 2 to 7%.

12. A porcelain cleaner kit as in claim 11, where the scrubbing member comprises:

(a) a handle that is made of plastic, resin, rubber, or any other material suitable to withstand pressure during cleaning of porcelain surfaces;

(b) a support member, made of same material as brush handle; and (c) bristles that comprise hair-like structures, comprising nylon, nylon-polyester blend, or rubber, or any other material suitable to clean porcelain surfaces without abrasion and have ends that are shaped into points to facilitate cleaning of hard to reach areas.

13. A porcelain cleaner kit as in claim 12, wherein the cleaning composition further comprises a surfactant, and a food grade preservative.

14. A porcelain cleaner kit as in claim 13, wherein the pumice is sufficiently strong to maintain a substantial portion of its structural integrity under forces of the type and magnitude normally employed by the hand in performing a scrubbing operation.

15. A porcelain cleaner kit as in claim 1, wherein the composition applicator has a pointy tip.

16. A porcelain cleaner kit as in claim 1, wherein the composition applicator comprises a handle supporting a sponge base and a fibrous member secured to an exposed surface of said sponge.

17. A porcelain cleaner kit as in claim 16, wherein the composition applicator has a pointy tip.

18. A cleaning composition for porcelain comprising abrasive material and a carrier, wherein the carrier is water-based and the abrasive material comprises pumice with a particle size distribution such that at least 35 percent of the particles fall are 250 to 750 microns and wherein the carrier comprises a biodegradable gum in an amount sufficient to act as a thickener and suspending agent for the pumice, the cleaning composition further comprising glycerin, said cleaning composition comprising between 30% and 60% by weight pumice, and said cleaning composition further comprises between 0.8% and 2.5% biodegradable gum and a thickener selected from one or more members of the group consisting of guar gum, locust bean gum, tara gum, xanthan, carrageenan, gellan gum and vegetable gum.

19. A cleaning composition for porcelain as in claim 18, wherein the pumice, for 1400 Micron or 14 U.S. Mesh allows 100% passing, for 600 Micron or 30 U.S. Mesh allows 99.7-100 passing, for 425 Micron or 40 U.S. Mesh allows 47%-67% passing, for 300 Micron or 50 U.S. Mesh allows 3% -17% passing, and for 250Micron or 60 U.S. Mesh allows 0% to 12% passing.

* * * * *